US005092105A

United States Patent [19]

Bish

[11] Patent Number: 5,092,105

[45] Date of Patent: Mar. 3, 1992

[54] LITTER BIN

[76] Inventor: Uen Bish-Shin, P.O. Box 82-144, Taipei, Taiwan

[21] Appl. No.: 573,335

[22] Filed: Aug. 27, 1990

[51] Int. Cl.[5] ..... B65B 51/14; B65B 67/00

[52] U.S. Cl. ..... 53/373.7; 53/390

[58] Field of Search ..... 53/373, 390, 266 R, 53/268, 570, 266.1, 373.7, 374.8, 375.6; 141/314, 316

[56] References Cited

U.S. PATENT DOCUMENTS

| | | | |
|---|---|---|---|
| 3,322,477 | 5/1967 | Armijo | 53/373 X |
| 3,323,714 | 6/1967 | Lewis | 53/390 X |
| 3,935,692 | 2/1976 | Miller | 53/390 X |
| 4,243,469 | 1/1981 | Evers et al. | 53/373 X |
| 4,553,377 | 11/1985 | Klinkel | 53/373 X |

FOREIGN PATENT DOCUMENTS

| | | | |
|---|---|---|---|
| 2385525 | 12/1978 | France | 53/390 |

*Primary Examiner*—John Sipos
*Assistant Examiner*—Linda B. Johnson
*Attorney, Agent, or Firm*—Alfred Lei

[57] ABSTRACT

This invention relates to a litter bin and in particular to one including a body portion with a movable portion therearound, a hollow lug provided on both sides of the body portion, a motor disposed within a hollow lug and connected with a pinion, an upper rack meshed with upper side of the pinion, a lower rack meshed with lower side of the pinion, two sealing boards respectively connected with the upper rack and the lower rack and provided with electric heating wires, and a pedal mounted on lower edge of the body portion for controlling the motor and the electric heating wire.

1 Claim, 3 Drawing Sheets

LITTER BIN

BACKGROUND OF THE INVENTION

It is found that the conventional litter bin is used in association with a plastic bag so as to prevent the litter from making it dirty. However, it is still necessary to tie a knot at the mouth of the plastic bag in order to keep the litter therein and so hands of the user may be dirtied. Further, the knot cannot completely seal the plastic bag and the liquid litter may be flowed out once the plastic bag is inadvertently handled.

Therefore, it is an object of the present invention to provide a litter bin which may obviate and mitigate the above-mentioned drawbacks.

SUMMARY OF THE INVENTION

This invention relates to an improved litter bin.

It is the primary object of the present invention to provide a litter bin which may automatically seal the mouth of a plastic bag.

It is another object of the present invention to provide a litter bin by means of which the user is not required to tie a knot at the mouth of the litter bag.

It is still another object of the present invention to provide a litter bin which may enable the user to be free from dirt.

It is still another object of the present invention to provide a litter bin which is simple in construction.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
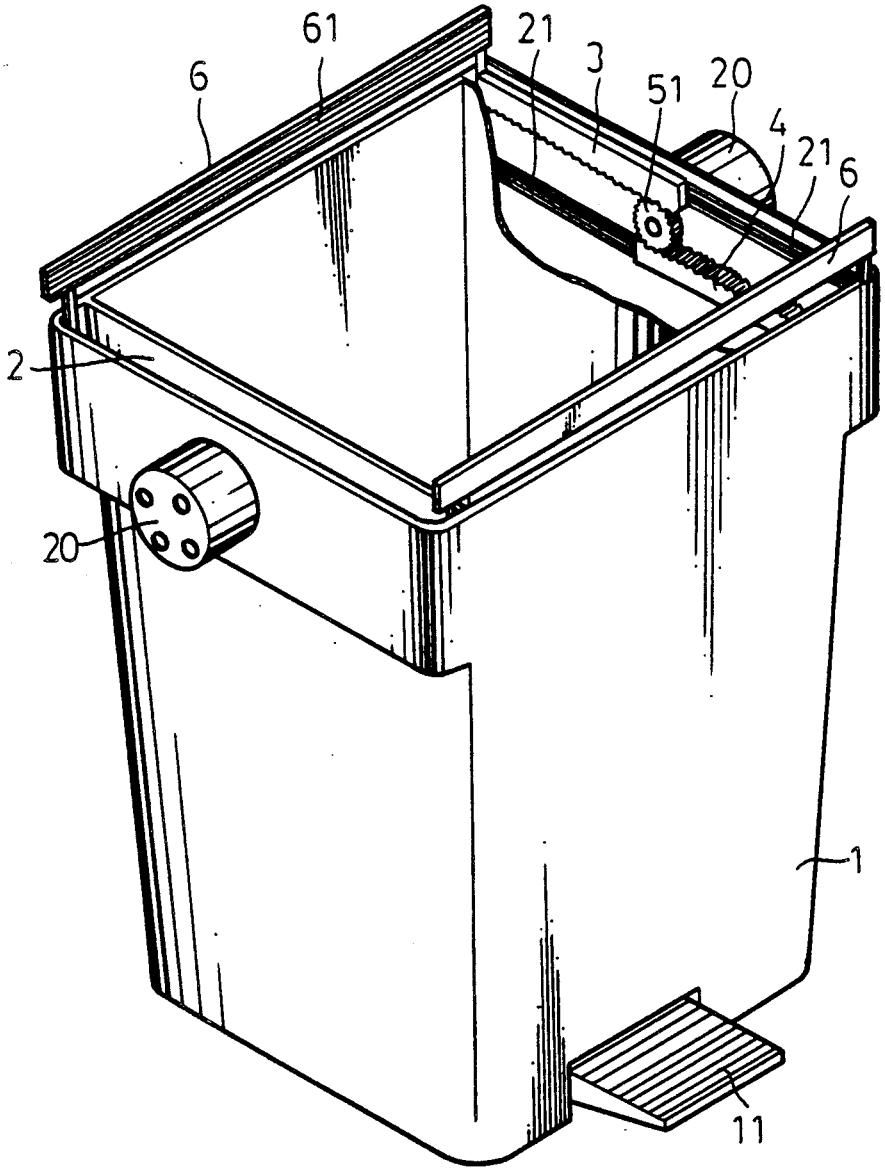
FIG. 1 is a perspective view of a litter bin according to the present invention.

With reference to the drawings and in particular to FIG. 1 thereof, the litter bin according to the present invention mainly comprises a body portion 1 with a groove 2 on both sides. On two opposite sides of the body portion 1 there is a hollow lug 20. A mini motor 5 is disposed within at least one of the hollow lug 20 and connected with a pinion 51 at its axle (not shown). The pinion 51 is located within the groove 2 and meshed with an upper rack 3 and a lower rack 4 which may be moved along the groove 2. The upper rack 3 and the lower rack 4 are respectively connected with a corresponding sealing board 6 at least one of which is provided with electric heating wires 61. A controlling pedal 11 with a micro-switch is provided at the lower edge of the body portion 1 for controlling the motor 5 and the electric heating wires.

Figure 2:
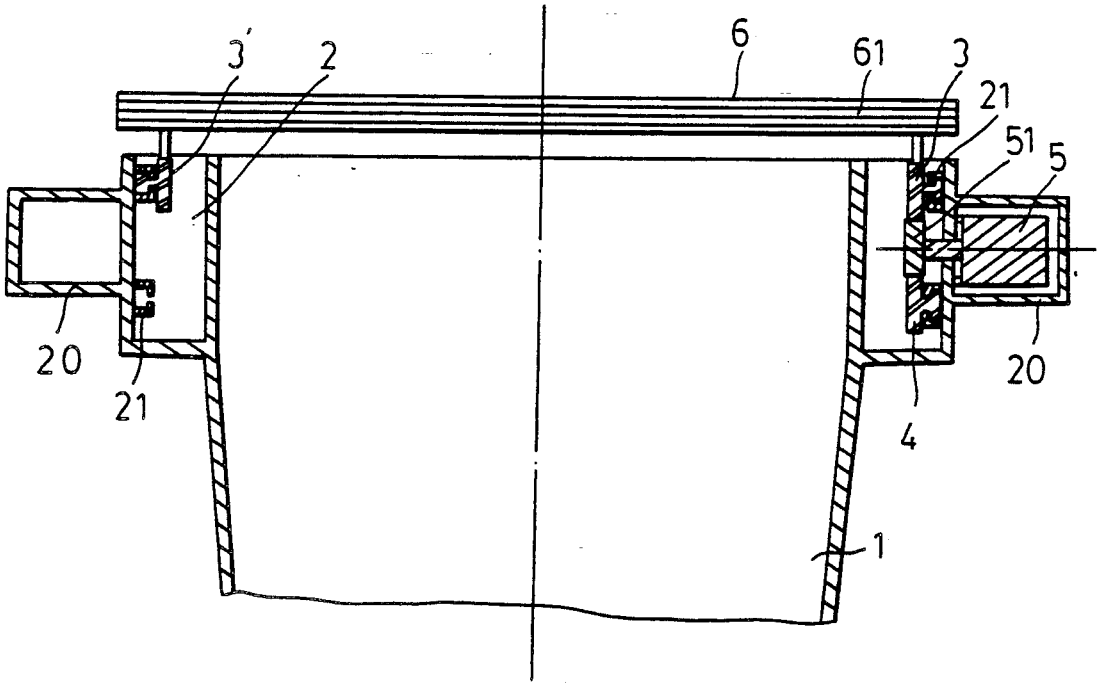
FIG. 2 is a front sectional view of the litter bin.

As may be seen at FIG. 2, the motor 5 is disposed within the lug 20 with the pinion 51 connected with the upper rack 3 and the lower rack 4 which are located within the groove 2 of the body portion 1. The upper rack 3 and the lower rack 4 are connected with a corresponding sealing board 6 so that the board 6 may be moved therewith.

Figure 3:
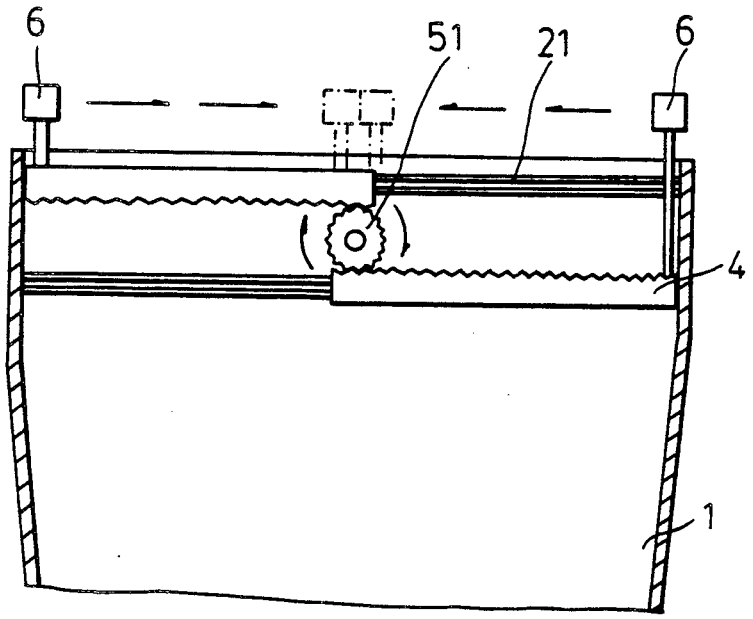
FIG. 3 is a side sectional view of the litter bin.

Referring to FIG. 3, when the pinion 51 is rotated clockwise by the motor 5, the upper rack 3 and the lower rack 4 will be driven to go towards each other thereby also moving the sealing boards 6 towards each other. As the controlling pedal 11 is pressed to start the motor 5, the electric heating wires 61 is heated and the sealing boards 6 are moved towards each other. When the sealing boards 6 are in contact with each other, the mouth of the plastic bag disposed within the body portion 1 will be melted together. Then the motor 5 will stop for a while and rotate in an opposite direction thereby moving back the sealing boards 6.

Other embodiments and modifications will occur to those skilled in the art. No attempts has been made to illustrate all possible embodiments of the invention, but rather intended such alternations and further applications as illustrated herein being contemplated as would normally occur to one skilled in the art to which the invention relates.

I claim:

1. A litter bin, for use in association with a plastic bag, comprising:

a body portion for surrounding and supporting a bag;

said body portion comprising opposite sides;

each said opposite side comprising:

a groove, a hollow lug mounted adjacent to said groove, a pinion mounted inside said groove, an upper rack meshed with an upper side of said pinion, and a lower rack meshed with a lower side of said pinion, said upper and lower racks mounted for movement within said grooves;

a motor mounted within at least one of said hollow lugs;

said motor connected to a pinion for rotating said pinion to cause movement of said racks;

two sealing boards extending perpendicularly to said sides;

one of said sealing boards connected to said upper racks for movement therewith;

the other said sealing board connected to said lower racks for movement therewith;

at least one of said two sealing boards being provided with electric heating wires; and a pedal mounted on a lower edge of said body portion for controlling said motor and said electric heating wires to open and close said sealing boards and seal said bag.

* * * * *